United States Patent [19]

Harrington

[11] Patent Number: 4,641,583

[45] Date of Patent: Feb. 10, 1987

[54] FREE ROTATION SPROCKET, DRAG CHAIN CONVEYOR SYSTEM

[75] Inventor: Earl J. Harrington, Oxford, Mich.

[73] Assignee: Overhead Conveyor Company, Ferndale, Mich.

[21] Appl. No.: 634,553

[22] Filed: Jul. 26, 1984

[51] Int. Cl.[4] ..... B61B 3/00

[52] U.S. Cl. ..... 104/172.1; 104/196; 104/235; 198/803.01

[58] Field of Search ..... 104/172 R, 172 S, 235, 104/236, 117, 196; 198/648, 803.01, 803.02

[56] References Cited

U.S. PATENT DOCUMENTS

| | | | |
|---|---|---|---|
| 4,073,237 | 2/1978 | Wakabayashi | 104/172 S X |
| 4,227,609 | 10/1980 | Günther et al. | 198/648 X |
| 4,461,216 | 7/1984 | Carney | 104/172 S X |
| 4,470,355 | 9/1984 | Kunczynski | 104/196 |

FOREIGN PATENT DOCUMENTS

| | | | |
|---|---|---|---|
| 57350 | 8/1967 | German Democratic Rep. | 104/196 |
| 2034655 | 6/1980 | United Kingdom | 104/196 |

*Primary Examiner*—Robert B. Reeves
*Assistant Examiner*—David F. Hubbuch
*Attorney, Agent, or Firm*—Barnes, Kisselle, Raisch, Choate, Whittemore & Hulbert

[57] ABSTRACT

A power and free conveyor system wherein a plurality of conveyor units or trolleys in the form of part suspension frames and the like may be moved by a continuously moving chain but the relationship of the chain to each conveyor is such that no latching or unlatching of the units is necessary to stop a particular unit at a station or when a stack-up of conveyor units occurs. Resumption of motion occurs automatically when intentional stopping or stack-up is relieved. The drive chain engages a plurality of freely rotating sprockets arranged on the trolley in a manner in which the chain forms a loop diverging from the general alignment of the chain. The acceleration and drive of the trolleys is thus controlled by a variable tension arrangement on one of the drive sprockets of the chain.

2 Claims, 7 Drawing Figures

FREE ROTATION SPROCKET, DRAG CHAIN CONVEYOR SYSTEM

FIELD OF INVENTION

A power and free conveyor wherein conveyor elements are driven by a chain and the forward motion of individual conveyors can be interrupted.

BACKGROUND AND OBJECTS OF THE INVENTION

In the so-called "power and free" conveyor systems with a continuously moving chain loop, the individual conveyor units or trolleys, which are moved by the chain, are usually latched to the chain for a driving relationship and must be unlatched to stop the individual units. Some systems are designed such that if a stack-up occurs, that is several units bump into each other when a leading unit is stopped, the contact of one following unit with the unit ahead of it will unlatch the following unit from the moving chain. The free unit must be again latched into the chain in order for forward motion to resume.

It is an object of the present invention to provide a moving chain conveyor system for conveyor units which has the equivalent function of a power and free conveyor but has a chain relationship with the moving units such that no latching or delatching is required to effect movement or non-movement of the suspended units.

Briefly, this is accomplished by providing rail suspension of the conveyor units, whether they be part hangers, buckets, or other carrier devices, and providing on each unit a set of three chain engaging gears or sprockets on parallel axes, one being on an axis offset from the other two so that there is an over-and-under relationship of the chain to the sprockets. This relationship causes the units to move with the chain unless mechanically blocked. If it is blocked, the chain will turn the sprockets and the particular unit will remain stationary. When the unit is released, it will again move with the chain.

In U.S. Pat. No. 4,227,609 (1980), there is shown a bucket conveyor with a looped chain or rope to drive the buckets but these buckets are fixed on the chain with no concept of relative motion with respect to the chain except to allow the bucket to swing relative to the axle on which it is located. In U.S. Pat. No. 3,968,754 (1976), a loop chain construction utilizes the main and upper sprocket as a drive so the mining machine pulls itself along the chain. A similar disclosure is found in U.S. Pat. No. 4,235,475 (1980), and U.S. Pat. No. 3,892,184 (1975).

Another feature of the invention lies in a system which allows tightening of the closed drive chain loop to increase the drive relationship of the chain to the over-and-under loop at each conveyor unit. Chain tightening devices are known in patents of which U.S. Pat. No. 4,284,192 (1981) is representative but the present combination to be disclosed utilizes the chain tightening for a significantly different purpose.

Other objects and features of the invention will be apparent in the following description and claims in which the invention is set forth, together with details to enable persons skilled in the art to practice the invention, all in connection with the best mode presently contemplated.

BRIEF DESCRIPTION OF THE DRAWINGS

Drawings accompany the disclosure and the various views thereof may be briefly described as.

DETAILED DESCRIPTION OF THE INVENTION AND THE MANNER AND PROCESS OF USING IT

Figure 1:
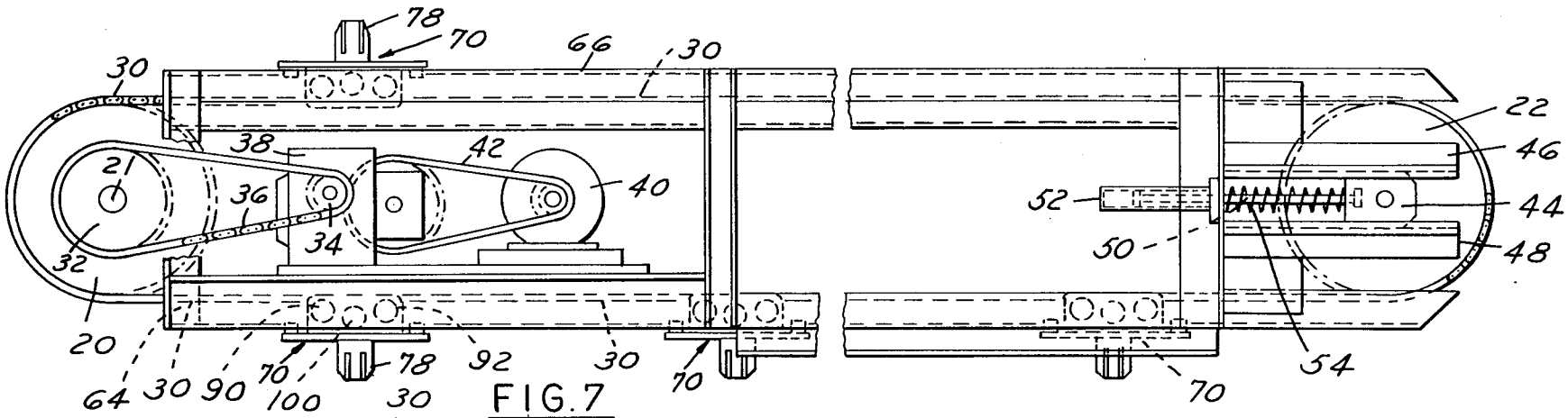
FIG. 1, a side view of an apparatus utilizing the invention is a closed loop conveyor in which the drive sprockets are on a horizontal axis.

In FIG. 1, a side view of a conveyor apparatus is illustrated in which the supporting sprockets 20 and 22 are mounted on horizontal axes. It will be appreciated that the apparatus could be utilized also with the sprocket axes vertically disposed and in this case FIG. 1 would be a plan view of the assembly.

In FIG. 1, the sprocket 20 on an axle 21 is the driving sprocket for a chain loop 30 running over sprockets 20 and 22. A drive sprocket or pulley 32 secured to sprocket 20 is driven by a gear reducer output sprocket or pulley 34 through a chain 36. The gear reducer 38 is driven by a motor 40 through a pulley-belt and assembly 42. The sprocket 22 is rotatably mounted in a journal block 44 which in turn is slidably mounted in upper and lower slide tracks 46, 48. A piston rod 50 extending from a piston-cylinder 52 connects to slide block 44. Suitable pressure source and valving (not shown) can direct pressure to cylinder 52 to impart an extra tensioning force on the chain loop 30 as will be explained below. A compression spring 54 can maintain a basic tension on the chain loop.

Figure 6:
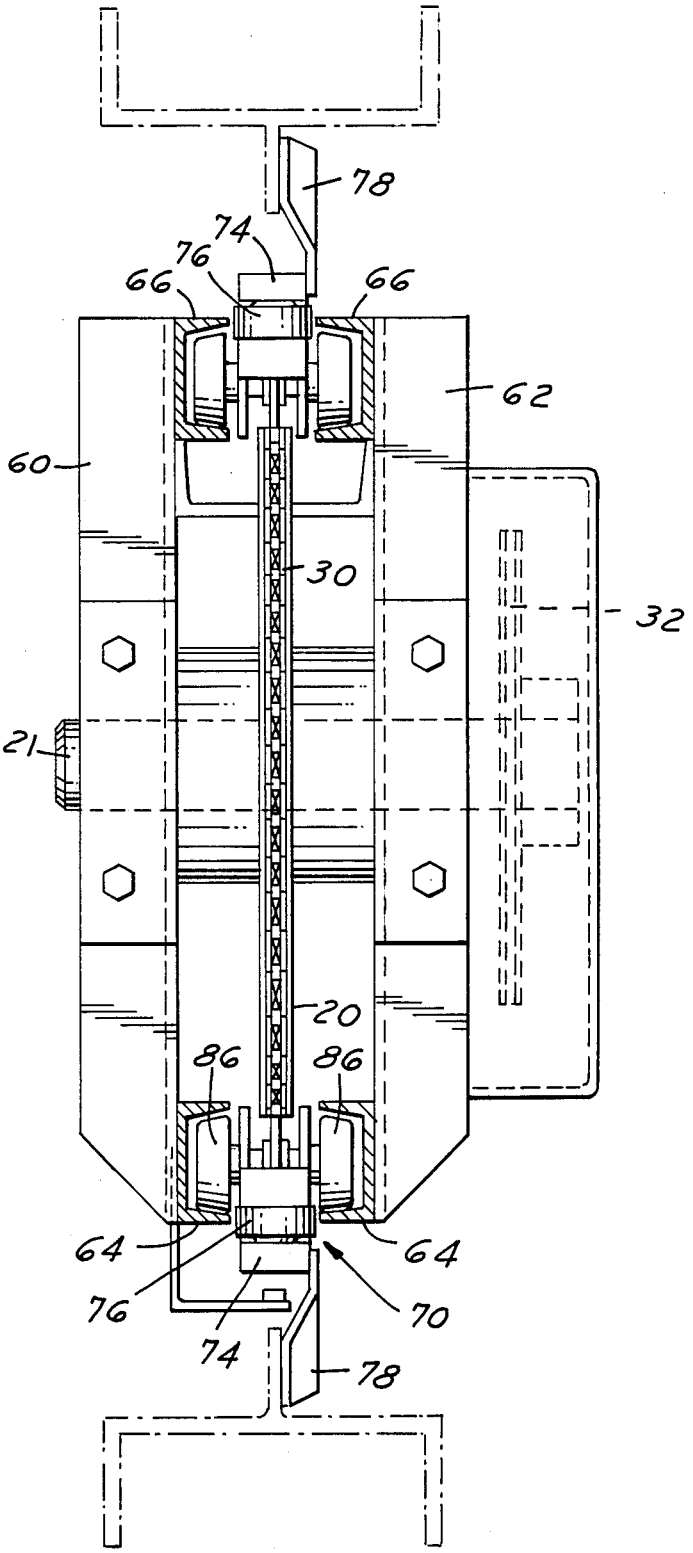
FIG. 6, an end view of the assembly from the left-hand drive end of FIG. 1.

As shown in the end view of FIG. 6, taken at the left-hand end of FIG. 1, the sprocket 20 is mounted in suitable frame members 60, 62 which also support upper and lower double guide C-channels 64 and 66, respectively.

Figure 2:
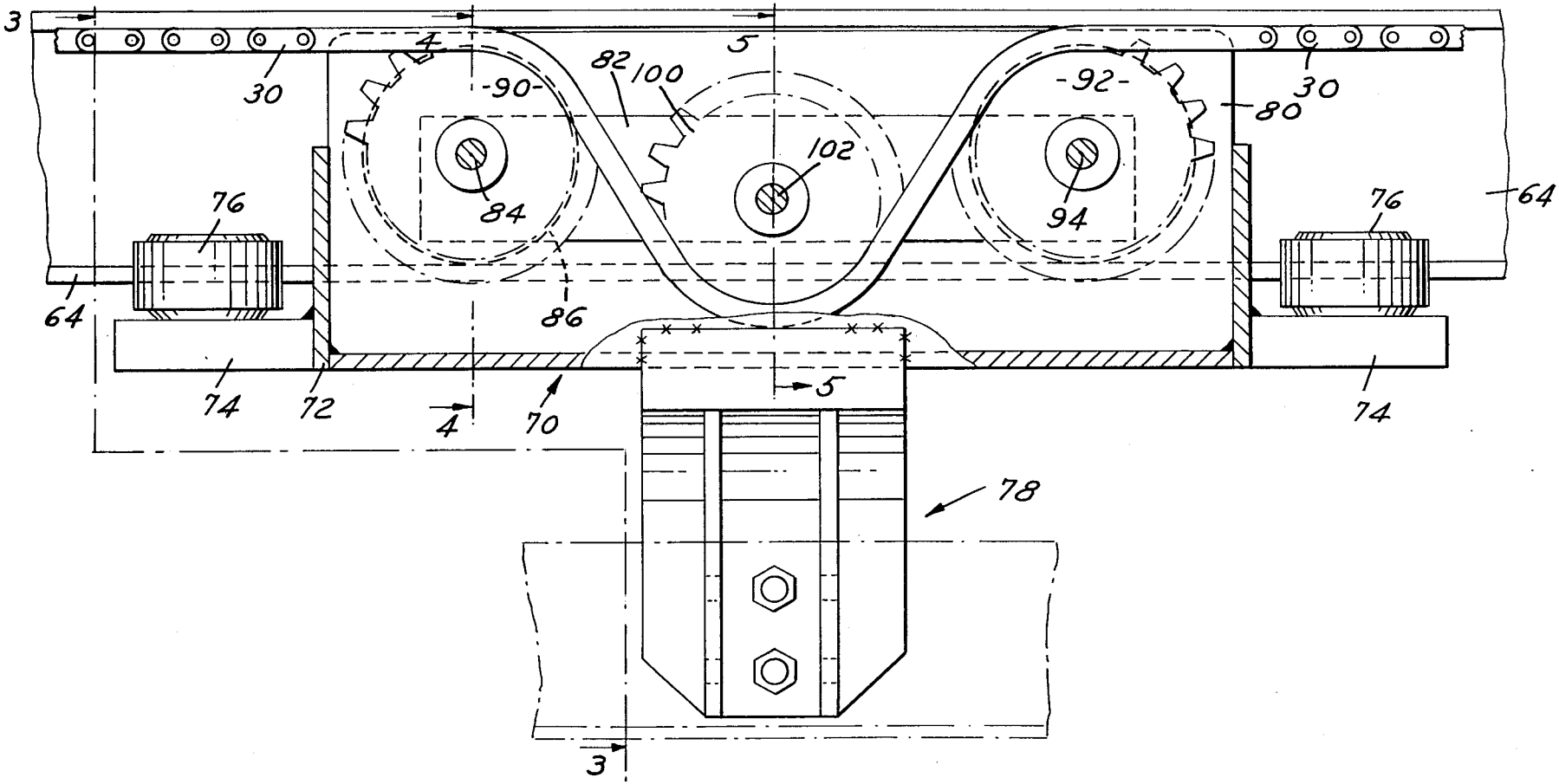
FIG. 2, an enlarged view of a segment of the drive chain taken at a conveyor unit.
Figure 3:
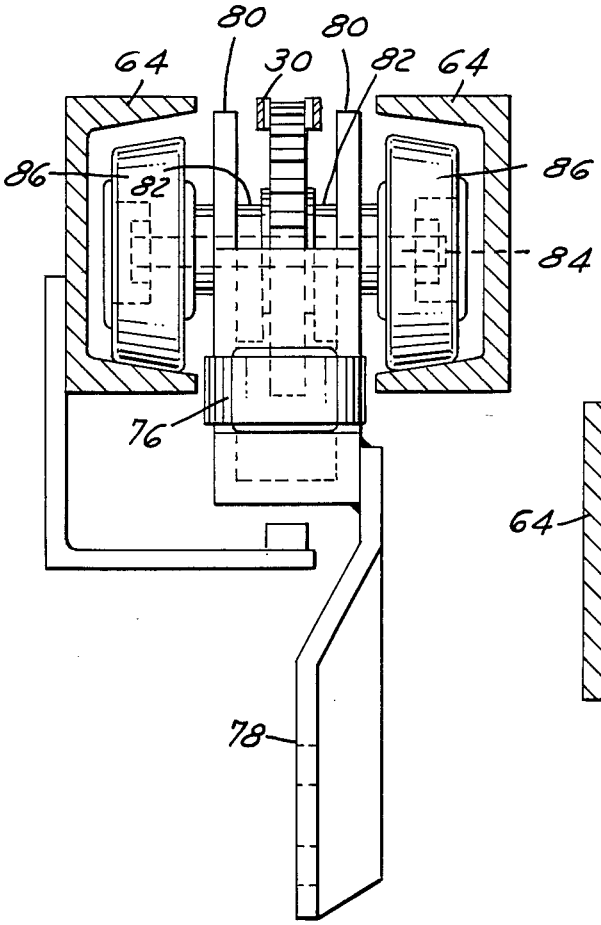
FIGS. 3, 4, and 5, sectional views on lines 3—3, 4—4 and 5—5 of FIG. 2.
Figure 4:
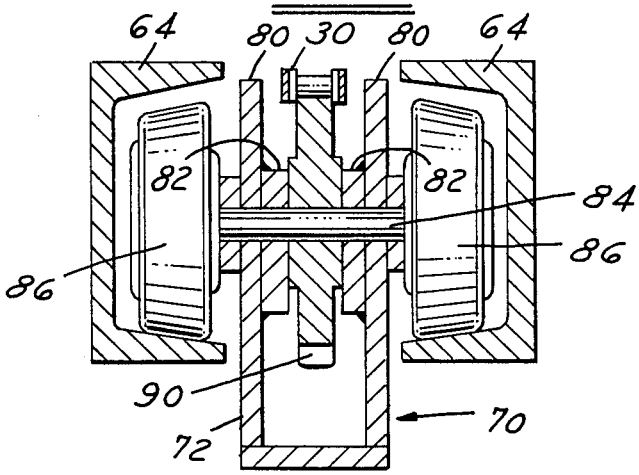

We refer now to the individual conveyor units which are moved by the chain 30. These units may be referred to as trolleys indicated generally at 70. An enlarged side view of the trolley 70 is shown in FIG. 2. A housing 72 open at the top has end projections 74 carrying guide rollers 76. Depending from the housing 72 is a load-carrying bracket 78 which carries a basket or hanger for a work part or any other device to be conveyed. The trolley housing 72 has side walls 80 with inside cheek plates 82 secured to the inner surfaces. Those side walls 80 and the cheek plates 82 are transfixed by an axle shaft 84 illustrated in the sectional view of FIG. 4. Support rollers 86 are mounted on the ends of axle shaft 84 to ride on load-carrying support channels 64 previously described on the bottom run and channels 66 on the top run. On the axle 84 is a sprocket 90 journaled for free rotation between the cheek plates 82.

In FIG. 2, it will be seen that an identical sprocket 92 is journaled in the same manner on an axle shaft 94.

Figure 5:
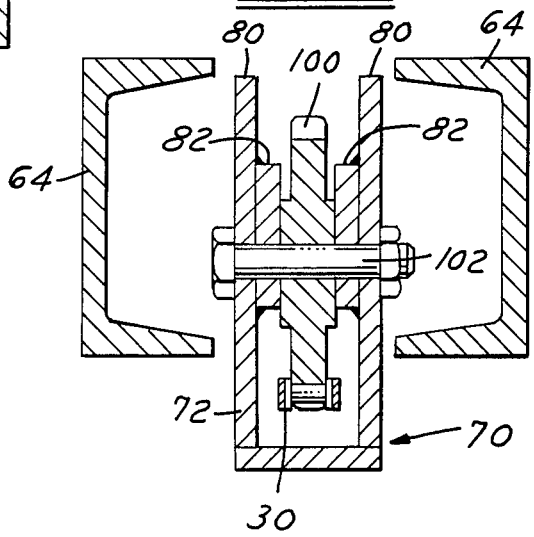

With reference to both FIGS. 2 and 5, a section through the trolley 70 between the sprockets 90 and 92 reveals a third sprocket 100 rotatable on an axle shaft 102 and located between cheek plates 82.

As will be seen in FIG. 2, the chain 30 rides over the top of end sprockets 90 and 92 and under the central sprocket 100. The end guide rollers 76 ride between the lower channel edges of the C-channels 64.

Figure 7:
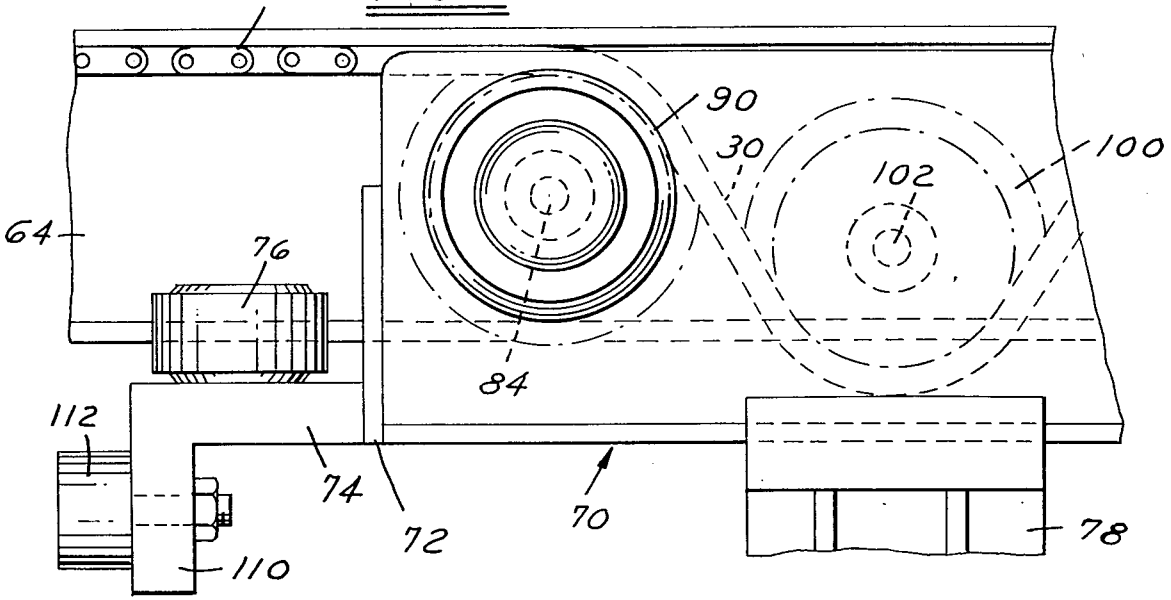
FIG. 7, a view of a modification of a conveyor unit.

In FIG. 7, a modified trolley construction is shown in which the block 74 carrying the side guide roller 76 has a depending bar 110 on which is mounted a resilient bumper 112. Both ends of the trolley would have the same construction.

In viewing FIG. 1, it will be appreciated that the trolley units 70 will move along the bottom run of the chain loop conveyor and when an end sprocket is reached will move up and around and engage the upper track 66 but in this run the trolleys will be upside down.

The driving force for each trolley 70 is the drag of the chain 30 as it passes over end sprockets 90 and 92 and loops under center sprocket 100. When no resistance is offered to the movement of the trolleys, the drag of the chain in this inverted loop will cause the trolleys to move with the chain. If a particular trolley is intentionally stopped, the chain 30 will continue to move but the trolley sprockets 90, 92 and 100 will rotate until the trolley is released for forward motion. If one trolley is stopped and a following trolley abuts the stationary trolley, the following trolley will again stop and the chain 30 will idle through it until the obstruction is removed.

Thus, the conveyor system serves as a power and free conveyor with no need to latch or unlatch the trolleys. In addition, acceleration can be controlled by the trolley relationship. Assuming that a trolley has been stopped and is then released, the slippage of chain 30 on the sprockets 90, 92, 100 will cause gradual acceleration. This can be controlled by the spacing of the trolley sprockets and the freedom of rotation of the trolley sprockets. If, for example, each trolley is carrying long suspended parts such as vehicle doors, the acceleration can be controlled so that these parts will not be set to swinging where damage might be due by contact with adjacent suspended parts.

What is claimed is:

1. A conveyor system in which a continuously moving power-driven chain drive is provided with a plurality of conveyor trolleys to be moved in a predetermined path by said chain drive and in which a plurality of chain engaging free rotating first sprockets on said trolley are positioned to guide said chain in a loop diverging from the general alignment of said chain wherein said loop creates a drag resistance which causes said trolley to move with said chain in said path when the path of the trolley is unobstructed, that improvement in which opposed C-channels are disposed in spaced relation to provide a guide path for said first sprockets, at least two of said plurality of first sprockets being mounted for free rotation on axles extending transversely to said C-channels, support rollers on each end of said axles positioned to run on opposed ledges formed by one side of said C-channels, spaced members on said conveyor trolleys supported vertically on said axles on opposite sides of each said two sprockets, and guide rollers spaced longitudinally on said trolleys positioned between said opposed ledges to provide a horizontal guide for said trolleys.

2. A conveyor system in which a continuously moving power-driven chain drive is provided with a plurality of conveyor trolleys to be moved in a predetermined path by said chain drive, that improvement which comprises a plurality of chain engaging free rotating first sprockets on said trolley positioned to guide said chain in a loop diverging from the general alignment of said chain wherein said loop creates a drag resistance which causes said trolley to move with said chain in said path when the path of the trolley is unobstructed, drive sprockets spaced longitudinally from each other on parallel axes carrying the chain drive in a closed loop path, one of said drive sprockets being power driven to move said chain in said closed loop path, means mounting one of said drive sprockets for sliding motion transversely, to its axis, means biasing said last one of said drive sprockets in a direction away from the other of said drive sprockets to maintain a tension on said chain drive, and power means to move said last one of said drive sprockets in said same direction to increase the tension on said chain drive and control the acceleration of said trolleys.

* * * * *